United States Patent [19]

Doser et al.

[11] 3,933,536

[45] *Jan. 20, 1976

[54] METHOD OF MAKING MAGNETS BY POLYMER-COATING MAGNETIC POWDER

[75] Inventors: Manfred Doser, Edmore, Mich.; Daniel Edwin Floryan, Pittsfield, Mass.

[73] Assignee: General Electric Company, Schenectady, N.Y.

[ * ] Notice: The portion of the term of this patent subsequent to Dec. 20, 1991, has been disclaimed.

[22] Filed: Nov. 3, 1972

[21] Appl. No.: 303,424

[52] U.S. Cl. ..... 148/105; 148/31.57; 148/108; 264/DIG. 58

[51] Int. Cl.[2] ..... H01F 1/02

[58] Field of Search ..... 148/105, 31.57, 108, 103; 427/212; 264/65, DIG. 58

[56] References Cited

UNITED STATES PATENTS

| | | | |
|---|---|---|---|
| 1,982,689 | 12/1934 | Polydoroff | 264/DIG. 58 |
| 3,726,664 | 4/1973 | Parker et al. | 148/105 |
| 3,849,213 | 11/1974 | Baermann | 148/108 |

*Primary Examiner*—Walter R. Satterfield

[57] ABSTRACT

Magnets are produced by dissolving in a solvent organic polymer which is a binder for magnetic powder, adding a magnetic powder to the solution, then adding to the solution a vehicle in which the polymer is insoluble. The vehicle is added until the polymer has precipitated onto the magnetic particles. These coated particles are then dried and hot pressed within an orienting magnetic field to produce the magnet.

5 Claims, No Drawings

METHOD OF MAKING MAGNETS BY POLYMER-COATING MAGNETIC POWDER

BACKGROUND OF THE INVENTION

Permanent magnet properties of bulk magnetic materials having large magnetocrystalline anisotropies can be enhanced by reducing them to powders. Such powders can be incorporated in bonding media to provide composite permanent magnets having properties substantially superior to those of the bulk source materials. Powders can be prepared by grinding or by chemical means. It is common practice to add plastic to magnetic particles by adding polymer solution to the powder and mixing. The solvent is later removed leaving large pieces of briquettes of randomly oriented material. This material must be reground to a powder before being subjected to a pressing and alignment cycle. However, powders have a large surface area per unit volume and, therefore, tend to be reactive. For example, if a powder of cobalt-rare earth material is exposed to air its coercive force will decrease irreversibly due to the oxidation of the particle.

Since the reactivity of the powder particles appears to be a surface phenomenon, efforts have been directed toward reducing the reactivity by coating the surface with a protective material. One way to accomplish this is by applying a coating of zinc or arsenic as disclosed and claimed in Becker et al. U.S. Pat. No. 3,615,914, which is assigned to the same assignee as the present invention.

Once the cobalt-rare earth particle is protected by a metallic coating such as zinc, it is mandatory that this coating be unaffected by abrasion, or cleavage of the particle. Therefore, the common technique of regrinding the bulk magnet-plastic binder composite is not desirable for highly reactive materials such as cobalt-rare earth particles because of the abrasion and cleavage of particles which takes place during this operation.

The present invention has for its object to provide a method for protecting the surface of magnetic powder material from changes which would degrade the magnetic properties of the material. Another object is to provide a method for coating a magnetic particle which does not need to be subjected subsequently to grinding. A further object is to provide magnetic powder particles with a surface which will serve as a lubricant to help achieve maximum packing density without serious abrasion during a subsequent hot-pressing step. An additional object is to provide magnetic particles with a polymer coating which will serve to hold the aligned magnetic particles together after pressing.

SUMMARY OF THE INVENTION

In accordance with the present invention, magnetic powder particles are individually coated with a polymeric material such as a polycarbonate. In a preferred form, the magnetic particles are first coated with a protective metal such as zinc after the manner disclosed and claimed in the above-mentioned Becker el al patent. Polymer-coated magnetic particles are then hot-pressed in a die — preferably under the influence of a magnetic field — to produce a magnet having the desired configuration and anisotropic properties. Isotropic properties are also enhanced by this coating.

DESCRIPTION OF PREFERRED EMBODIMENTS

The magnetic powder particles of this invention are coated with a layer of polymer by precipitation from a solution containing the polymer. The polymer is dissolved in a solvent for the polymer and the magnetic particles are then added to the solution which is agitated. An insoluble vehicle is then added to the solution with the result that the polymer is precipitated onto the magnetic particles. The particles are then separated from the solution and dried to produce a powder without going through a grinding step. The powder is then hot-pressed in a mold having the configuration and magnetic moment direction desired in the final magnetic product.

This invention applies to finely divided magnetic materials such as ferrite powders, alnico powders and cobalt-rare earth (CoR) powders (where R represents some rare earth element). A few examples of such systems are $Co_5Sm$, $Co_5Pr$, $Co_5Nd$, $Co_5MM$ (mischmetal) or combinations of rare earths $Co_5SmPr$, $Co_5SmPrNd$, $Co_5SmMM$, or $Co_{17}R_2$, $Co_{17}Sm_2$, $Co_{17}Pr_2$, or $(Co, Fe)_{17}Sm_2$,$(Co, Fe)_{17}R_2$ where R is a rare earth element in 58-71 atomic number series. It is particularly useful in the case of cobalt-rare earth powders in view of their tendency to degrade in magnetic properties. This is illustrated in the following examples which are intended to be illustrative rather than limiting.

EXAMPLE 1

A polycarbonate (20 grams of Lexan) was dissolved in 200 grams of methylene chloride. This solution was agitated in a laboratory mixer and 200 grams of $Co_5Sm$ having a particle size range of 125–500 microns was slowly added to the solution. While maintaining agitation methanol was slowly added to precipitate the polycarbonate onto the particles of $Co_5Sm$. The coated powder was then air dried to remove solvent from the surface of the polycarbonate-coated particles. A quantity (3.5 grams) of the coated powder was placed in a stainless steel die maintained at a temperature of 250°C and a field of 12,000 gauss was applied to align the particles. During the alignment step a pressure of 120,000 psi was applied to the powder. The product consisted of 7% polycarbonate by weight and had a packing fraction of 58.3%. The intrinsic coercive force of the product was 12,200 oersteds. Subsequent measurements of the coercive force after exposure in air at temperatures up to 100°C gave the same reading.

EXAMPLE 2

In this example the particles of $Co_5Sm$ were the same size as those used in Example 1 but they were coated with 3% zinc by weight. No polymer coating was applied but the hot pressing step was the same as in Example 1. The product had a packing fraction of 71% and an intrinsic coercive force of 8900 oersteds. The coercive force continued to decrease after exposure to air at elevated temperatures.

EXAMPLE 3

This example combines Example 1 and Example 2. The $Co_5Sm$ particles were the same size as in Example 1 but were coated with 3% zinc by weight as in Example 2. A coating of 7% by weight of polycarbonate was added as in Example 1 over the zinc. The resulting product had a packing fraction of 58.3% and an intrinsic coercive force of 12,200 oersteds.

EXAMPLE 4

In this example the $Co_5Sm$ particles had a size range of 125–297 microns and a coating of 5% zinc by weight. No polymer coating was applied. The procedure was otherwise the same as in Example 2. The resulting product had a packing fraction of 71.5% and an intrinsic coercive force of 8600 oersteds.

EXAMPLE 5

In this example the $Co_5Sm$ particles consisted of approximately 50% with a coating of 1% zinc by weight and 6% polycarbonate by weight. The other 50% was $Co_5Sm$ particles with a coating of 5% zinc by weight but no polycarbonate. The hot pressing procedure was the same as in Example 1. The product had a packing fraction of 72.9% and an intrinsic coercive force of 13,100 oersteds.

The foregoing examples demonstrate that a polymer coating over a zinc coating provides a magnetic particle with properties which are improved over those of a magnetic particle having just a zinc coating. It is evident that the polymer coating acts as a lubricant which makes the particles more responsive to the orienting magnetic field and at the same time prevents the particles from rubbing together and removing the zinc protective coating. In addition, the structural strength of magnets composed of polymer-coated particles is greater than the structural strength of magnets composed of particles having metallic coatings. For example, the following samples were measured using a transverse rupture test similar to ASTM C120-52 to determine the physical strength of the compacts.

| Sample | Rupture Strength |
|---|---|
| Magnet with a coating of 5% zinc by weight | 842 psi |
| Magnet with 3% polycarbonate by weight | 4844 psi |

In the above examples the polymer was a polycarbonate. However, other polymer-solvent systems can be used in the practice of this invention. For example, polyphenylene oxide can be used with toluene as solvent. Poly (1,4-butanediol terephthalate) can be used with phenol as a solvent. Phenol is also the solvent used with polyethylene terephthalate or poly (hexamethylene adipamide). Toluene is a good solvent to use with polystyrene or poly (methyl methacrylate). With acrylonitrile-butadiene-styrene polymers chloroform is a preferred solvent.

Suitable non-solvents for the systems recited above for use in precipitating the resins onto the magnetic particles are alcohols or similar non-solvents.

While the invention has been described with reference to specific embodiments, it is obvious that there may be variations which properly fall within the concept of the invention. Accordingly, the invention should be limited in scope only as may be necessitated by the scope of the appended claims.

What we claim as new and desire to secure by letters patent of the United States is:

1. The method of making a permanent magnet which comprises:

dissolving in a solvent an organic polymer which is a binder for magnetic particles;

adding particles of magnetic powder to the resulting solution;

adding to said solution a vehicle in which said polymer is insoluble until the polymer precipitates onto the particles; and hot pressing the polymer-coated particles into a compact to form a magnet.

2. The method of claim 1 in which the magnetic particles are selected from the group consisting of cobalt-rare earth and alnico particles.

3. The method of claim 1 wherein the hot pressing step is carried out within an orienting magnetic field.

4. The method of claim 1 wherein the binder is a polycarbonate resin.

5. The method of claim 4 wherein the solvent is methylene chloride and the vehicle is methyl alcohol.

* * * * *